US007535335B2

(12) United States Patent
Brioschi

(10) Patent No.: US 7,535,335 B2
(45) Date of Patent: May 19, 2009

(54) ANTI-CONDENSATE RESISTANCE WITH PTC THERMISTOR AND PROCESS FOR ASSEMBLING SUCH RESISTANCE

(75) Inventor: Roberto Brioschi, Borgoticino (IT)

(73) Assignee: Gianus S.p.A., Milan (IT)

( * ) Notice: Subject to any disclaimer, the term of this patent is extended or adjusted under 35 U.S.C. 154(b) by 343 days.

(21) Appl. No.: 11/572,315

(22) PCT Filed: Jul. 22, 2005

(86) PCT No.: PCT/IT2005/000430

§ 371 (c)(1),
(2), (4) Date: Jan. 18, 2007

(87) PCT Pub. No.: WO2006/011177

PCT Pub. Date: Feb. 2, 2006

(65) Prior Publication Data

US 2008/0191835 A1 Aug. 14, 2008

(30) Foreign Application Priority Data

Jul. 27, 2004 (IT) ..... TO2004A0523

(51) Int. Cl.
*H01C 1/024* (2006.01)

(52) U.S. Cl. ..... 338/237; 338/49; 338/51

(58) Field of Classification Search ..... 338/237, 338/49, 51, 53, 57, 159, 256
See application file for complete search history.

(56) References Cited

U.S. PATENT DOCUMENTS 4,935,717 A 6/1990 Osawa et al.

(Continued)

FOREIGN PATENT DOCUMENTS

DE 20311068 U1 9/2003

(Continued)

OTHER PUBLICATIONS

International Search Report issued in parent International Patent Application PCT/IT2005/000430 (4 pages).

*Primary Examiner*—Kyung Lee
(74) *Attorney, Agent, or Firm*—David A. Farah; Sheldon Mak Rose & Anderson PC

(57) ABSTRACT

An anti-condensate resistance (1) with PTC thermistor 5 is disclosed, comprising a central heat sink element (3), such central heat sink element (3) being composed of two dissipating plates (3*a*, 3*b*) which are mutually facing and continuously joined in such a way as to form, in a space interposed between the plates, an inserting housing (15) of the PTC thermistor 5 together with a securing element (11), a first and a second closing plugs (7*a*, 7*b*) for closing openings of the inserting housing (15) and for hermetically sealing the PTC thermistor 5 inside the inserting housing (15); the dissipating plates (3*a*, 3*b*) being equipped with a convex curvature towards their center, each one of the dissipating plates (3*a*, 3*b*) being equipped at their ends with inserting tracks (4*a*, 4*b*) forming working portions (6*a*, 6*b*) on which forces (F) are exerted which are adapted to permanently set joining hourglasses (4*c*) of the dissipating plates (3*a*, 3*b*) for cancelling or reverting the curvature and blocking the PTC thermistor 5 in the inserting housing (15) and the closing plugs (7*a*, 7*b*) in the openings, and each one of the dissipating plates (3*a*, 3*b*) being equipped on an external surface with a plurality of dissipating wings (13); a process for assembling such anti-condensate resistance (1) is further described.

14 Claims, 5 Drawing Sheets

U.S. PATENT DOCUMENTS

| | | | | | |
|---|---|---|---|---|---|
| 5,049,852 | A | * | 9/1991 | Cummins et al. | 338/280 |
| 5,239,163 | A | * | 8/1993 | Brouwers | 219/202 |
| 5,481,241 | A | * | 1/1996 | Caddock, Jr. | 338/51 |
| 5,563,570 | A | * | 10/1996 | Lee | 338/50 |
| 6,563,213 | B1 | * | 5/2003 | Wong et al. | 257/727 |

FOREIGN PATENT DOCUMENTS

| | | | |
|---|---|---|---|
| JP | 10032101 | A | 2/1998 |
| JP | 11265802 | A | 9/1999 |
| JP | 2002198207 | A | 7/2002 |

* cited by examiner

ANTI-CONDENSATE RESISTANCE WITH PTC THERMISTOR AND PROCESS FOR ASSEMBLING SUCH RESISTANCE

CROSS-REFERENCE TO RELATED APPLICATIONS

The present application is a 371 of International Patent Application No. PCT/IT2005/000430, titled "Anti-Condensate Resistance with PTC Thermistor and Process for Assembling Such Resistance," filed Jul. 22, 2005, which claims priority from Italian Patent Application No. T02004A000523 filed Jul. 27, 2004, the contents of which are incorporated in this disclosure by reference in their entirety.

FIELD OF THE INVENTION

The present invention refers to an anti-condensate resistance with Positive Temperature Coefficient (PTC) thermistor; the present invention also refers to a process for assembling such resistance.

BACKGROUND INFORMATION

The use of PTC thermistors for realizing anti-condensate resistances is known.

PTC thermistors are devices made of conductive or semiconductive materials that have a varying resistance depending on temperature; consequently, PTC thermistors have the advantageous chance of self-regulating themselves depending on temperatures and in this way they are not subjected to overheating, even in case an adequate heat removal is prevented (for example, profile clogging, accidental heat sink coverage with any object, etc.). In particular, anti-condensate resistances using PTC thermistors are, in the majority of cases, composed of a heat sink made in a single aluminum profile inside which the PTC thermistor is arranged and segregated through closing plugs; however, the technical disadvantages of such arrangement are numerous. First of all, the realization of the heat sink in a single extrusion prevents the black anodization of its internal surfaces and therefore heat is for a good part transmitted through conduction instead of radiance; under these conditions, therefore the heat sink must be unavoidably manufactured with a certain minimum thickness in order to guarantee a good conduction level.

Moreover, crimping of the heat sink generally occurs through profile bending, this imposing a minimum height of the heat sink that is much greater than the height of the PTC thermistor, with consequent negative effects in terms of encumbrance and manufacturing costs.

It is also known that in existing embodiments, PTC thermistors are kept in position inside the heat sink through more or less complex mechanical arrangements, such as screws, bolts or springs, this obviously increasing their complexity and manufacturing costs. Such internal locking systems must further allow the thermal expansion of the heating element keeping an adequate contact load, which is as much as possible constant.

Such known anti-condensate resistances with PTC thermistors moreover exist also in a forced-ventilation version through an external fan; such fan however, in order to be able to be simply supplied directly through an electric network connection, is generally at 230V, thereby resulting relatively costly, encumbrant and oversized with respect to the power level to be dissipated.

Moreover, typically known and used closing plugs of a heat sink guarantee generally mediocre tightness levels.

The currently-used securing systems for anti-condensate resistances with PTC thermistors are normally made of metallic material, typically aluminum, to be able to resist thermal stresses; moreover, they are composed of many pieces: typically a carrier structure and various mobile and/or elastic parts (for example springs) that allow its elastic mechanical locking.

SUMMARY OF THE INVENTION

Therefore, object of the present invention is solving the above prior art problems by providing an anti-condensate resistance with PTC thermistor which, depending on modularity of elements composing it, allows to be configured in a productively very simple way with different types of heat sink.

A further object of the present invention is providing an anti-condensate resistance with PTC thermistor equipped with a heat sink realized by assembling many extruded profiles, this allowing both an internal and an external anodization in black or another color, with consequent increase of heat transmission by radiance, decrease and related saving of materials to be used to make such profiles.

A further object of the present invention is providing an anti-condensate resistance with PTC thermistor inside whose heat sink the PTC thermistor is operatively secured without the need of using further mechanical locking devices, though keeping a contact pressure that is almost constant in spite of its thermal expansion.

Moreover, an object of the present invention is providing an anti-condensate resistance with PTC thermistor equipped with closing plugs that guarantee a greater seal with respect to known closing plugs.

Another object of the present invention is providing an anti-condensate resistance with PTC thermistor with forced ventilation through a DC-supplied fan with low cost and minimum overall sizes.

A further object of the present invention is providing an anti-condensate resistance with PTC thermistor equipped with a system for securing it onto a DIN bar with a preferred shape, made of high-temperature resistant plastic material, since the mechanical characteristics of used plastics allow embedding the elastic part into the carrier structure, allowing to realize the securing system in a single piece, thereby avoiding any structural assembling working.

A further object of the present invention is providing an assembling for manufacturing an anti-condensate resistance with PTC thermistor.

The above and other objects and advantages of the invention, as will appear from the following description, are reached by an anti-condensate resistance with PTC thermistor as disclosed in claim 1.

Moreover, the above and other objects and advantages of the invention, as will appear from the following description, are reached by a process for assembling an anti-condensate resistance with PTC thermistor as disclosed in claim 13.

Preferred embodiments and non trivial variations according to the present invention are the subject matter of the dependent claims.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF PREFERRED EMBODIMENTS

Figure 1:
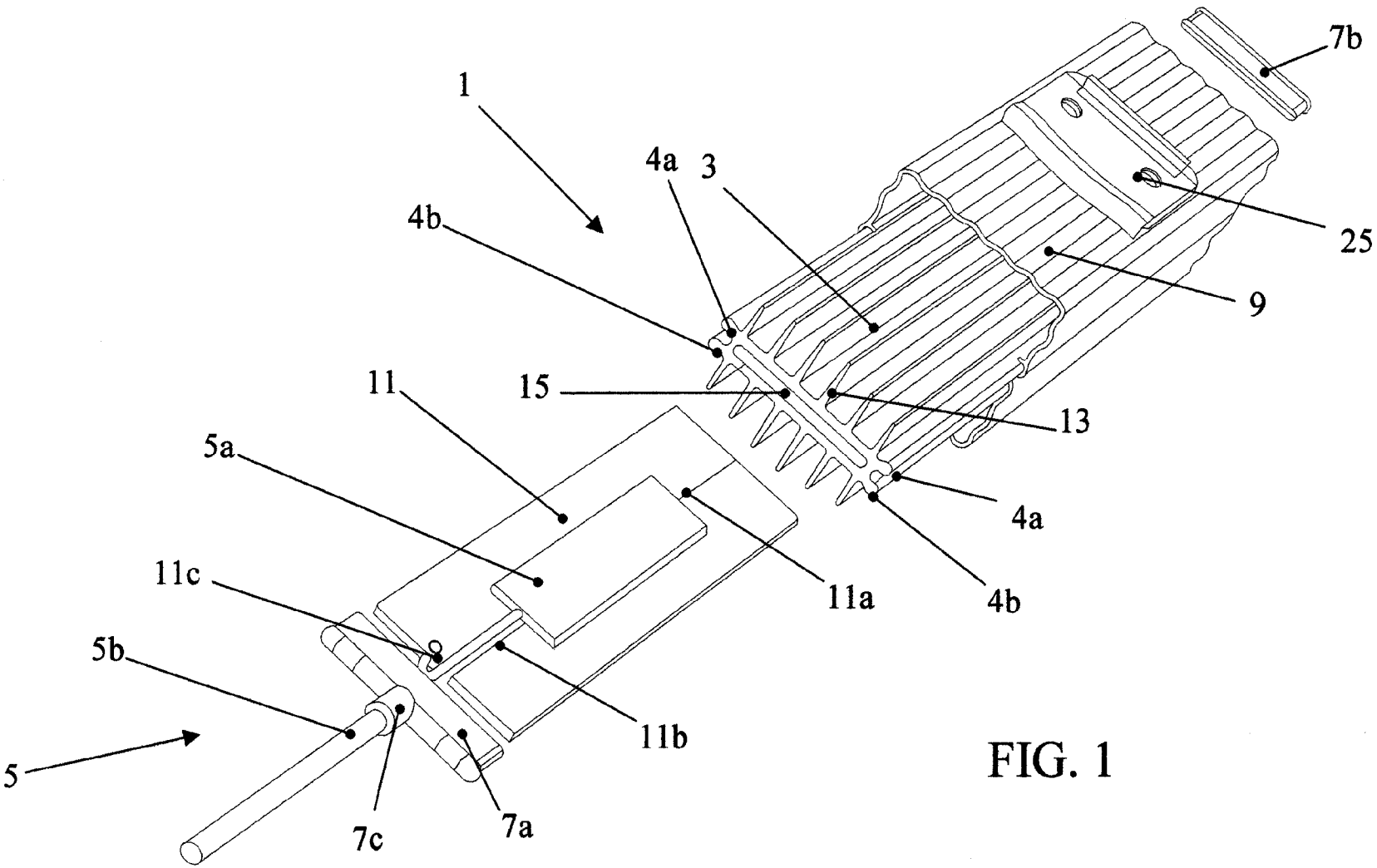
FIG. 1 shows an exploded perspective view of an embodiment of the anti-condensate resistance with PTC thermistor and related securing system according to the present invention.
Figure 3:
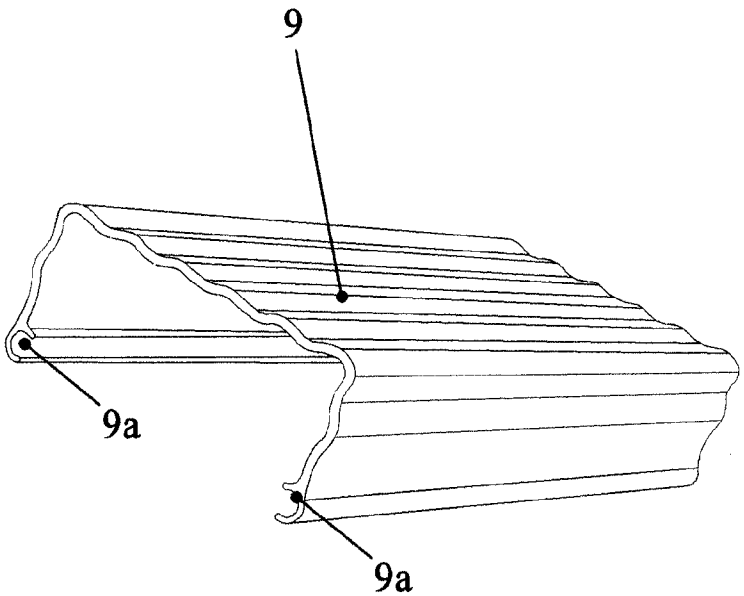
FIG. 3 shows a perspective view of another element of the anti-condensate resistance with PTC thermistor of FIG. 1.

With reference to FIG. 1, it is possible to note that the anti-condensate resistance 1 with PTC thermistor according to the present invention mainly comprises a central heat sink element 3 inside which the PTC thermistor 5 described below is arranged, a first and a second closing plugs, respectively 7*a*, 7*b* for closing and hermetically sealing the PTC thermistor 5 inside the central heat sink element 3; moreover, depending on the power to be dissipated, it is possible to place one or two covering profiles 9*m*, described below.

Figure 2:
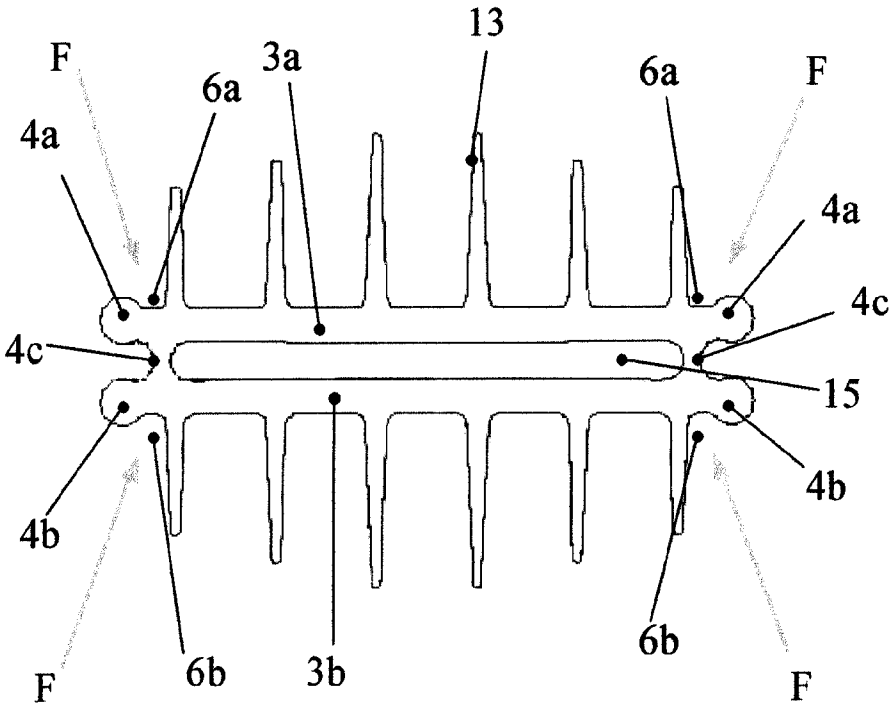
FIG. 2 shows a sectional view of an element of the anti-condensate resistance with PTC thermistor of FIG. 1.

With reference to FIG. 2, it is possible to note a sectional view of the central heat sink element 3: such central heat sink element 3 is substantially composed of two dissipating walls 3*a*, 3*b* mutually facing and joined in such a way as to form, in a space interposed between them, a housing 15 for inserting the PTC thermistor 5 described below, each wall equipped at its own ends with inserting tracks 4*a*, 4*b* of the covering profiles 9; such inserting tracks 4*a*, 4*b* have, in a joining portion with the respective dissipating plate 3*a*, 3*b*, some working portions 6*a*, 6*b* described below; each dissipating plate 3*a*, 3*b* is equipped on its external surface with a plurality of dissipating wings 13, preferably of a different height one to the other in order to maximize the convective sections and minimize air turbulences. Moreover, the surfaces of such wings 13 must be as smooth as possible, since possible very high grooves or roughnesses would reduce the convective effect due to reduced turbulences. It is moreover evident that the central heat sink element 3 can be anodized as black.

The PTC thermistor 5 according to the present invention is advantageously associated with an element adapted to be secured inside the housing 15, which can be realized simply and cheaply, which can be practically used and assembled that, as will be seen below, by cooperating with the central heat sink element 3, avoids using locking devices and mechanisms like in the prior art. With reference in particular to FIG. 1, it is possible to note a preferred embodiment of the PTC thermistor 5: in fact, it is a known PTC thermistor 5 equipped with a known conducting or semiconducting element 5*a*, substantially shaped as a blade, to which a cable 5*b* for transporting electric current is connected; an advantageous aspect according to the present invention is that such element adapted to be secured, as shown in FIG. 1, is a diffusing plate 11 having in a substantially central position thereof a seat 11*a* inside which the element 5*a* is inserted and possibly a groove 11*b* for inserting the cable 5*b*; afterwards, the diffusing plate 11 coupled with the PTC thermistor 5 is inserted into the housing 15 of the central heat sink element 3. The diffusing plate 11 performs many functions:

as previously mentioned, it keeps the PTC thermistor 5 in position;

it helps diffusing heat on the whole width of the central heat sink element 3;

through a connection 11*c*, for example a hole, it allows an easy grounding;

it fills in the residual space of the inserting housing 15, reducing or removing the use of additional plastic filling materials.

An advantageous and innovative aspect according to the present invention is that the dissipating plates 3*a*, 3*b* are arc-shaped (with a curvature radius that can be determined by the modulus of Young of the material, by its section and by the applied compression force) in such a way that the housing 15 of the PTC thermistor 5 is slightly narrower towards its center; the curvature of the plates 3*a*, 3*b* in fact makes them work as leaf springs; by applying, for example through crimping, some forces of arrows F shown in FIG. 2 (at least 1 Ton×cm of length in case the central heat sink element 3 is made of aluminum) on the working portions 6*a*, 6*b* of the tracks 4*a*, 4*b*, a permanent set (about 0.6 mm) is caused to the joining hourglasses 4*c* of the dissipating plates 3*a*, 3*b*, this generating the cancelling or even the reversal of their curvature; such permanent set imposes a pressure (as an optimum of about 80 Kgf) of the dissipating plates 3*a*, 3*b* on the PTC thermistor 5 and on the diffusing plate 11 or on the locking plate 5*c*, operatively locking them inside the central heat sink element 3, thereby advantageously removing the need of having to use further locking systems. In particular, the diffusing plate 11 can be preferably made of annealed aluminum equipped with waving: due to such waving, the diffusing plate is strongly secured in the inserting housing 15 during crimping, without interfering with the elastic force which compressed the PTC.

The closing plugs 7*a*, 7*b*, adapted to be placed on the two opposite openings of the inserting housing 15 for guaranteeing hermetic seal protecting the PTC thermistor 5 inserted in the central heat sink element 3, can be realized, being their volume reduced, by using noble materials. In particular, the first closing plug 7*a* comprising a cable-pressing device 7*c* for passing the cable 5*b* can be made in a single piece. Moreover, such closing plugs 7*a*, 7*b* do not need gaskets, though guaranteeing a seal at least equal to IP65 since, after crimping, the pressure produced by the dissipating plates 3*a*, 3*b* keeps them hermetically blocked.

In particular, preferable materials for manufacturing the closing plugs 7*a*, 7*b* can be both thermoplastic and thermosetting (rubbers).

Moreover, the anti-condensate resistance 1 with PTC thermistor 5 according to the present invention also comprises a securing system 25 of the resistance itself on a DIN bar; such securing system 25 is made of plastic material, preferably PA, such material resisting to high temperatures and allowing to make the securing system 25 in a single piece, with relevant saving in manufacturing costs.

The covering profiles 9, preferably produced through extrusion, due to their section substantially shaped as a "C", can be completely black anodized and therefore can be much thinner than what can be found in the art, since a lot of heat arrives through radiance instead of conduction, thereby allowing an important saving of material and production resources. Moreover, the covering profiles 9 should be made with a sufficiently elastic material, in order to remove every critical aspect in the extrusion process. Each covering profile 9 is further equipped on both its longitudinal edges related to the "C" profile end with two grooves 9*a* adapted to be slidingly inserted in the tracks 4*a*, 4*b* of the central heat sink element 3.

As already mentioned, the anti-condensate resistance 1 according to the present invention can be configured, depending on affected powers, by using different combinations of the above-described elements for realizing different heat sinks, for example by assembling none, one or two covering profiles 9 on the central heat sink element 3. Moreover, such different heat sinks can be realized for complying with different power needs, by changing the length of the central heat sink element 3, of the covering profiles 9 and/or the critical temperature of the PTC thermistor 5.

Figure 4:
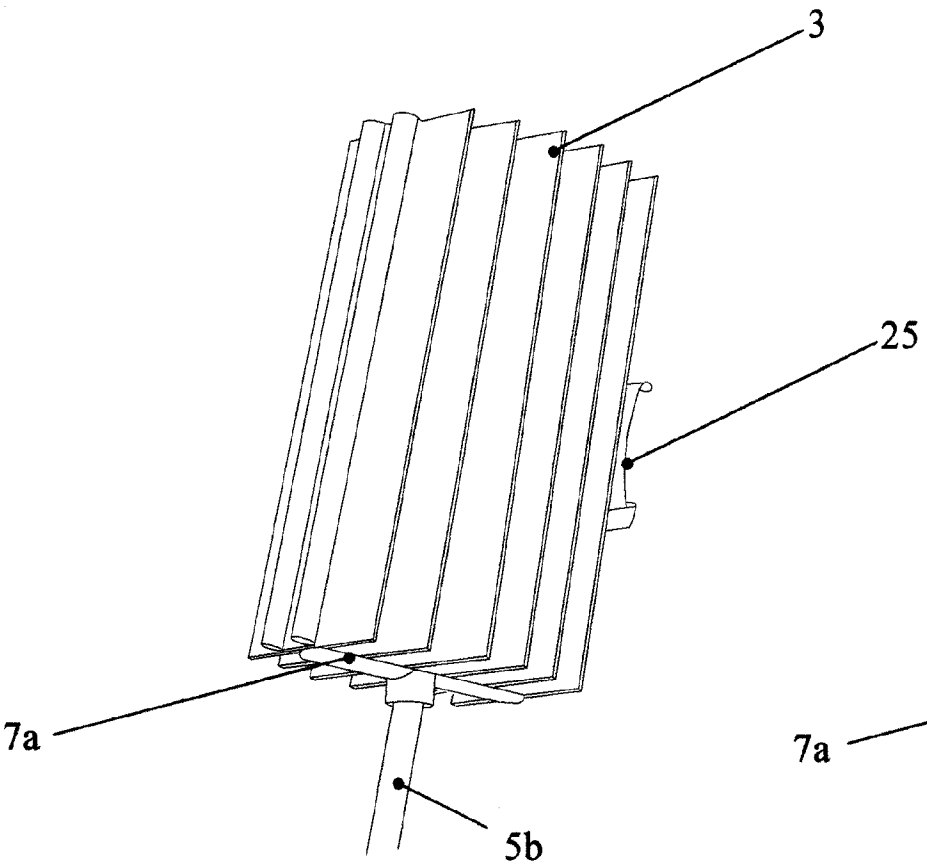
FIG. 4 shows a perspective view of a version of the anti-condensate resistance with PTC thermistor according to the present invention.

In particular, FIG. 4 shows, as an example, an anti-condensate resistance 1 according to the present invention for powers included in the 5-15 W range. Such anti-condensate resistance 1 is realized by using as dissipating element only the central heat sink element 3, inside which the PTC thermistor 5 is placed, as previously described. Moreover, such central heat sink element 3 can be equipped with an external securing bracket 19 for its operating positioning. In particular, due to the particular arrangement of the dissipating wings 13 that are higher in the central position of the respective dissipating plates 3*a*, 3*b*, the anti-condensate resistance 1 in such configuration can be assembled in direct contact with electric apparata to be served, without excessively impairing the "chimney effect".

Figure 5:
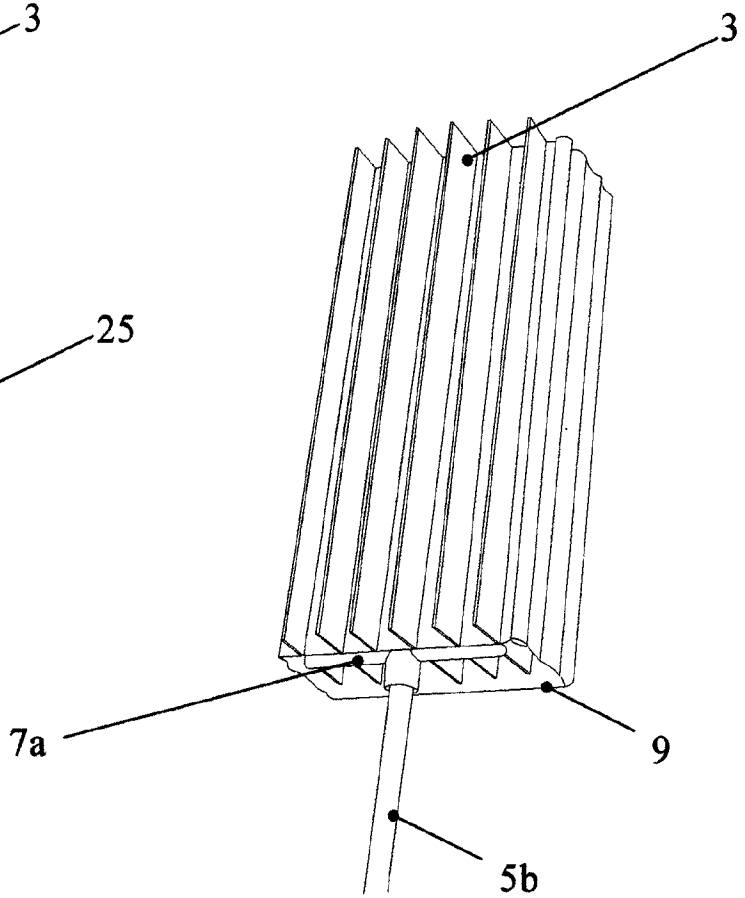
FIG. 5 shows a perspective view of another version of the anti-condensate resistance with PTC thermistor according to the present invention.

With reference to FIG. 5, it is possible to note, as an example, an anti-condensate resistance 1 according to the present invention for powers included in the 20-30 W range. Such anti-condensate resistance 1 is realized by using as dissipating element the central heat sink element 3, inside which the PTC thermistor 5 is placed, as described previously, on which a single covering profile 9 is inserted. Such anti-condensate resistance 1 arrangement mainly operates due to the chimney effect on the side of the central heat sink element 3 equipped with the covering profile 9, while it mainly operates by radiance on the opposite side.

Figure 6:
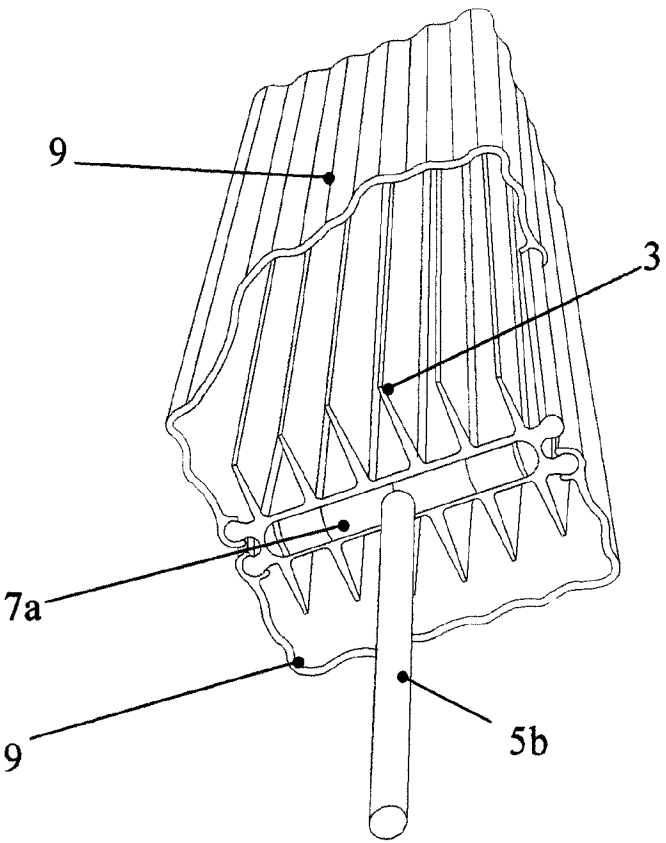
FIG. 6 shows a partially sectioned, perspective view of still another version of the anti-condensate resistance with PTC thermistor 5 according to the present invention.

With reference to FIG. 6, it is possible to note, as an example, an anti-condensate resistance 1 according to the present invention for powers included in the 35-70 W range. Such anti-condensate resistance 1, as previously seen, is realized by using as dissipating element the central heat sink element 3, inside which the PTC thermistor 5 is placed, as described previously, on which two covering profiles 9 are inserted. Such anti-condensate resistance 1 arrangement is preferably characterized by a mediocre thermal cutting towards the outside, in such a way as to be able to rise the central heat sink element 3 temperature without dangers.

Figure 7:
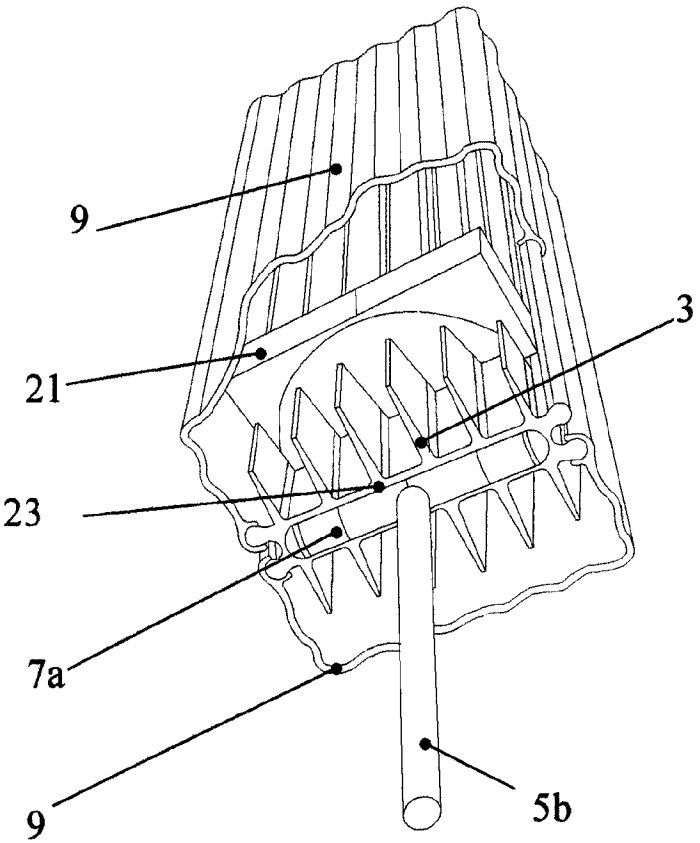
FIG. 7 shows a partially sectioned, perspective view of an anti-condensate resistance with PTC thermistor with forced ventilation according to the present invention.

FIG. 7 shows in particular an embodiment of the anti-condensate resistance 1 according to the present invention for powers included in the 75-150 W range, equipped with an electric fan 21 for forced cooling ventilation. Such electric fan 21 is supplied with direct current and therefore it is advantageously of low cost and reduced encumbrance; the front block 23 contains the electronics for supplying and/or driving the electric fan; such electric fan 21 is preferably arranged in order to generate an air flow which is parallel to the dissipating wings 13 passing between the central heat sink element and the covering profiles 9.

Figure 8:
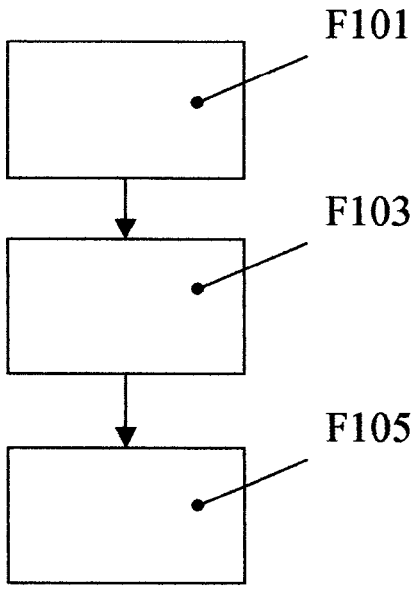
FIG. 8 shows a flow diagram showing the steps of the process for assembling an anti-condensate resistance with PTC thermistor according to the present invention.

FIG. 8 schematically shows the process for assembling an anti-condensate resistance 1 according to the present invention; in particular, such process, obviously after the manufacturing of the individual components with the most suitable modes, comprises the steps of:

inserting (F101) the PTC thermistor 5 into the inserting housing 15 of the central heat sink element 3;

inserting (F103) the closing plugs 7*a*, 7*b* into the openings of the inserting housing 15; and through a crimping press, exerting (F105) some forces F on the working portions 6*a*, 6*b* for permanently setting the dissipating plates 3*a*, 3*b* in such a way as to cancel or reverse their curvature and blocking the PTC thermistor 5 inside the inserting housing 15 and the closing plugs 7*a*, 7*b* in the openings of the inserting housing 15.

Figure 9:
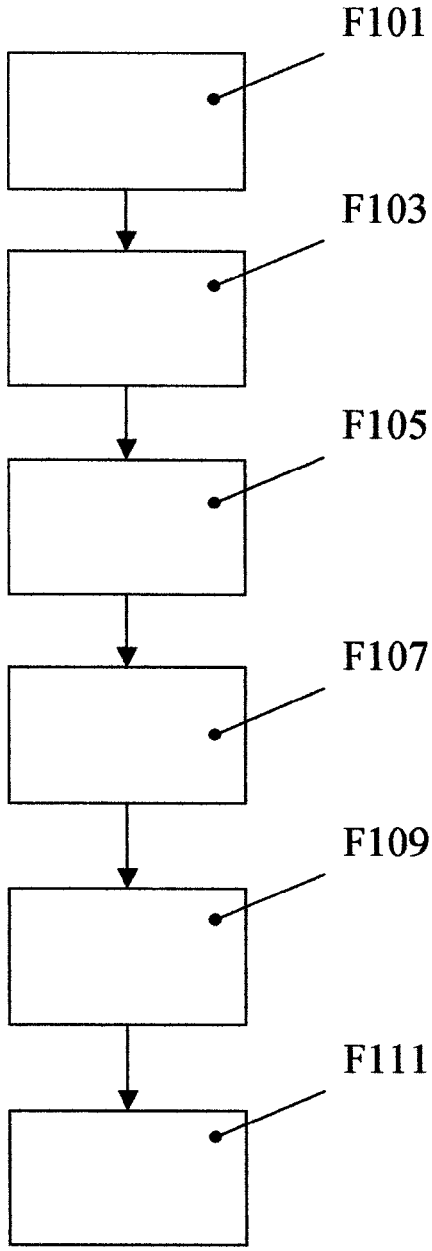
FIG. 9 shows a flow diagram representing the steps of the process for assembling another embodiment of the anti-condensate resistance with PTC thermistor according to the present invention.

The process according to the present invention provides, as shown in FIG. 9 and depending on the configuration of the heat sinks to be manufactured, also the following additional steps:

through a crimping press, performing (F107) a projection-punching on at least two tracks 4*a*, 4*b* related to the same dissipating plate 3*a*, 3*b;* placing (F109) at least one covering profile 9 on the central heat sink element 3 by inserting each track 4*a*, 4*b* into a respective groove 9*a* until it abuts against the punched projection;

pressing (F111) through a press the covering profiles 9 placed on the central heat sink element 3 and sliding the grooves 9*a* on the respective tracks 4*a*, 4*b* until the punched projection is passed, thereby blocking them on the central heat sink element 3 itself.

The invention claimed is:

1. An anti-condensate resistance with PTC thermistor that prevents the formation of condensate thereon, comprising:

a) a central heat sink element, the central heat sink element comprising two dissipating plates which are mutually facing and continuously joined in such a way as to form, in a space interposed between the plates, a housing for inserting the PTC thermistor together with an element adapted to be secured inside the housing;

b) a first and a second closing plugs for closing openings of the housing and for hermetically sealing the PTC thermistor inside the housing;

wherein the dissipating plates have a cross-section that is centrally curved with a convex curvature, each one of the dissipating plates being equipped at their ends with inserting tracks adapted to form working portions, the working portions being adapted to be subjected to forces in order to permanently set joining sections of the dissipating plates, so that the dissipating plates are adapted to elastically press onto the PTC thermistor, at the same time cancelling the curvature of the dissipating plates in order to maximize a contact surface between the dissipating plates and the PTC thermistor in the housing and to block the closing plugs in the openings, each one of the dissipating plates being equipped on an external surface with a plurality of dissipating wings.

2. The anti-condensate resistance with PTC thermistor of claim 1, wherein the resistance comprises at least one securing system, the securing system being made of plastic material in a single piece.

3. The anti-condensate resistance with PTC thermistor of claim 1, wherein the central heat sink element is anodized.

4. The anti-condensate with PTC thermistor of claim 1, wherein the dissipating wings have different heights.

5. The anti-condensate with PTC thermistor of claim 1, wherein the element adapted to be secured is a diffusing plate having, in a substantially central position thereof, a seat for housing a conductive or semiconductive element of the PTC thermistor.

6. The anti-condensate resistance with PTC thermistor of claim 5, wherein the diffusing plate is equipped with a grounding connection.

7. The anti-condensate with PTC thermistor of claim 5, wherein the diffusing plate is equipped with an inserting groove of an electric connection cable of the PTC thermistor.

8. The anti-condensate with PTC thermistor of claim 5, wherein the diffusing plate is made of waved annealed aluminum.

9. The anti-condensate with PTC thermistor of claim 1, wherein the resistance comprises at least one covering profile whose section is substantially "C"-shaped, the covering profile being equipped on both its longitudinal edges with a respective groove adapted to be slidingly inserted into a respective inserting track.

10. The anti-condensate resistance with PTC thermistor of claim 9, wherein the covering profile is completely anodized.

11. The anti-condensate with PTC thermistor of claim 1, wherein the resistance comprises an electric fan supplied with direct current and an electronic for supplying or driving the electric fan integrated in a front block.

12. The anti-condensate with PTC thermistor of claim 1, wherein the closing plugs comprise thermoplastic or thermosetting material.

13. A process for assembling an anti-condensate resistance with PTC thermistor of claim 1, the process comprising the steps of:

a) inserting the PTC thermistor into the housing of the central heat sink element with the element adapted to be secured;

b) inserting the closing plugs into the respective openings of the housing; and c) through a crimping press, exerting forces on the working portions for permanently setting the dissipating plates, the permanent set being adapted to cancel or reverse the curvature and to block the PTC thermistor inside the housing and the closing plugs in the respective openings of the housing.

14. The process of claim 13, the process comprising the additional steps of:

d) through a crimping press, performing a projection-punching on at least one of the tracks related to a same dissipating plate;

e) placing at least one of the covering profiles on the central heat sink element inserting each track in a respective groove until the track abuts against the punched projection; and f) pressing through a press the at least one covering profile placed on the central heat sink element and sliding the grooves on the respective tracks until the punched projection is passed.

* * * * *